US005531630A

United States Patent [19]

Crosta

[11] Patent Number: 5,531,630

[45] Date of Patent: Jul. 2, 1996

[54] SEAM PROTECTING DEVICE FOR DRUM GRINDING OR RAISING MACHINES

[76] Inventor: Emanuele Crosta, Corso Sempione, 67, 21052 Busto Arsizio (Varese), Italy

[21] Appl. No.: 204,766

[22] Filed: Mar. 1, 1994

[30] Foreign Application Priority Data

Mar. 4, 1993 [IT] Italy ..... MI93A0417

[51] Int. Cl.[6] ..... B24B 49/00

[52] U.S. Cl. ..... 451/5; 26/33; 26/17; 226/118; 226/52

[58] Field of Search ..... 451/8, 183, 188, 451/182, 211, 5; 26/28, 29 R, 33, 17, 27; 226/10, 52, 119, 118

[56] References Cited

U.S. PATENT DOCUMENTS

| | | | |
|---|---|---|---|
| 511,609 | 12/1893 | Gessner | 26/33 |
| 633,664 | 9/1899 | Schneider | 26/33 |
| 3,174,668 | 3/1965 | Waldo | 226/52 |
| 3,246,378 | 4/1966 | Beckers | 26/33 |

FOREIGN PATENT DOCUMENTS

| | | | |
|---|---|---|---|
| 1137713 | 10/1962 | Germany | 26/33 |
| 3211361 | 9/1988 | Japan | 26/33 |
| 0710259 | 6/1954 | United Kingdom | 26/33 |
| 1409870 | 10/1975 | United Kingdom | 26/33 |

*Primary Examiner*—Robert A. Rose
*Attorney, Agent, or Firm*—Bucknam and Archer

[57] ABSTRACT

A seam protecting device which can be applied to drum grinding or raising machines for preventing threads connecting adjoining pieces to be processed from breaking, has at least a pair of ring-like elements, parallel to one another and connected by means of connecting beams or bars, adapted to turn about bearings and a drum provided with raising or grinding cylinders. To the pair of ring-like elements there is applied a cusp element which, under a normal condition, is located at the bottom part of the drum.

14 Claims, 2 Drawing Sheets

SEAM PROTECTING DEVICE FOR DRUM GRINDING OR RAISING MACHINES

BACKGROUND OF THE INVENTION

The present invention relates to a seam protecting device, designed for application to drum grinding or raising machines, for preventing threads connecting pieces to be processed from accidentally breaking.

As is known, the drum raising and grinding machines conventionally comprise cylinder means for driving the fabric to be processed.

More specifically, with respect to the raising machine, the fabric is continuously supplied to a drum including several raising cylinders, on the surfaces of which there are provided a plurality of teeth which raise the surface of the fabric, by exerting a pulling action on the fibres forming the several threads.

In the grinding machines, on the other hand, the drum is provided with grinding cylinders, coated by abrasive strips, which subject the fabrics, preferably of cotton, lap, microfibre of silk type, to a suitable grinding or sanding action, so as to provide the fabric with a peach peel effect.

Both in the raising operation and in the grinding operation, the fabric is subjected to great mechanical stresses which cause the cotton or nylon threads used for connecting to one another two adjoining pieces to break.

At present, for overcoming the above mentioned drawback, the two above mentioned machines are provided, at the driving cylinders thereof arranged upstream of the drum, with a sensing element to detect the presence of seams.

This sensor, however, upon sensing the presence of seams, resets to zero the raising or grinding speed of the cylinders located on the drum, which usually turn about themselves.

Thus, a comparatively long length of the fabric piece is not processed, and it must be rejected, with a consequent great damage from the yield standpoint.

SUMMARY OF THE INVENTION

Accordingly, the object of the present invention is to overcome the above mentioned drawbacks, by providing a seam protecting device, for application to drum grinding or raising machines, adapted to prevent threads connecting adjoining pieces to be processed from accidentally breaking, which device is also adapted to process the portion of the fabric arranged near fabric seams, without causing any breakages of the cotton or nylon threads used for mutually connecting two adjoining pieces.

Another object of the present invention is to provide such a device which is very reliable and safe in operation, can be easily made by using easily commercially available elements and materials and, moreover, is very competitive from a mere economical standpoint.

According to one aspect of the present invention, the above mentioned objects, as well as yet other objects, which will become more apparent hereinafter, are achieved by a seam protecting device, for application to drum grinding or raising machines, adapted to prevent threads connecting adjoining pieces from breaking, characterized in that said device comprises at least a pair of ring-like elements adapted to turn about bearing means and a drum, to which there is applied a cusp element.

BRIEF DESCRIPTION OF THE DRAWINGS

Further characteristics and advantages of the invention will become more apparent hereinafter from the following detailed disclosure of a preferred, though not exclusive, embodiment of a seam protecting device, for application to drum grinding or raising machines, adapted to prevent threads connecting adjoining pieces to be processed from accidentally breaking, which is illustrated, by way of an indicative, but not limitative example, in the accompanying drawings, where.

DESCRIPTION OF THE PREFERRED EMBODIMENTS

Figure 1:
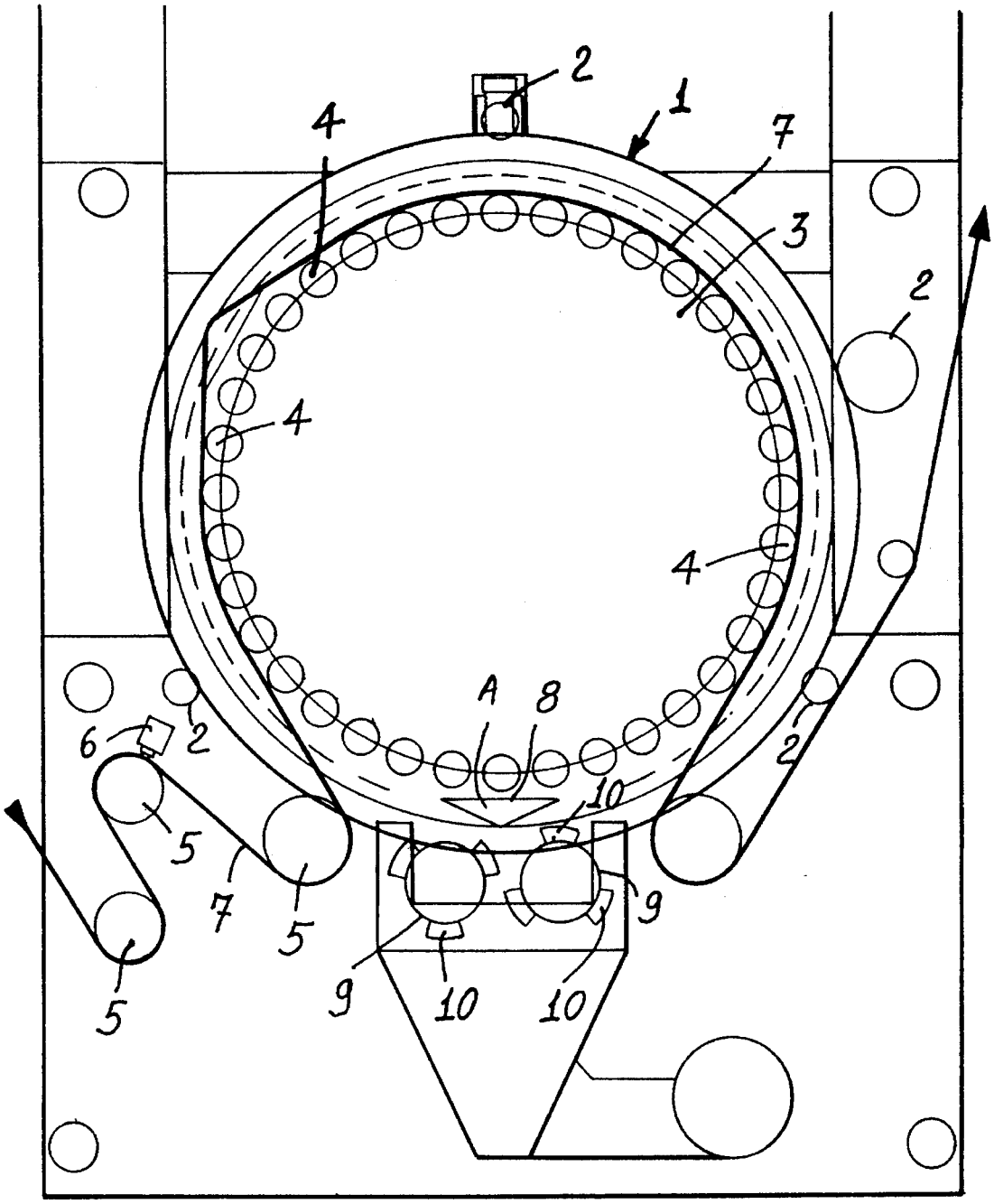
FIG. 1 is a front view of a grinding machine including the device according to the present invention.

With reference to the number references of the figures of the accompanying drawings, the seam protecting device, for application to drum grinding or raising machines, and specifically designed for preventing threads connecting adjoining pieces to be processed from being accidentally broken, comprises at least a pair of ring-like element, indicated at the reference number 1, which are parallel to one another and connected by connecting beams or bars.

These ring-like elements can turn about bearings 2 and a drum 3, including raising or grinding cylinders 4.

The fabric 7 to be processed by the cylinders 4 is supplied in a continuous manner to said drum by means of suitable driving cylinders 5 therewith there is associated a sensor 6.

Figure 2:
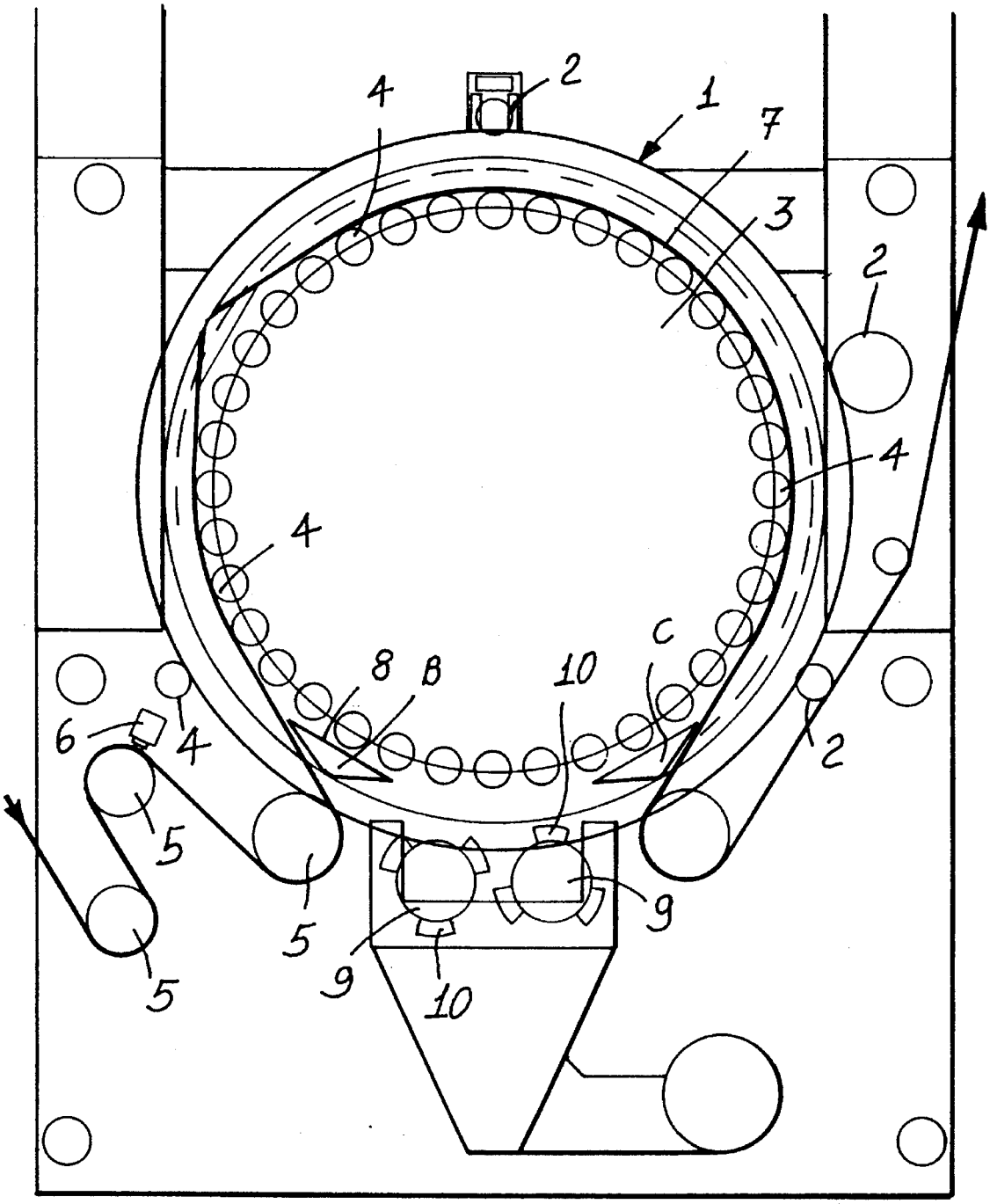
FIG. 2 is a front view of a raising machine also including a device according to the present invention.

To the pair of annular elements 1 there is applied a cusp element, indicated at the reference number 8, which, under a normal condition, is arranged at the position A, shown in FIG. 1, for the grinding machine and at the position B, shown in FIG. 2, for the raising machine.

To each of said machines, moreover, there are associated two cylinders, indicated at the reference number 9, including corresponding brush elements 10, the bristles or metal coatings of which are specifically designed for cleaning the raising or grinding cylinders.

In operation, as a seam is sensed by the sensor 6, there is started the counting operation of a pulse counting device for perfectly timing the displacement of the seam with that of the cusp element 8.

This cusp element, accordingly, has a peripheral rotary speed with respect to the drum 3 which is equal to the fabric advancement speed, thereby the cusp element 8 is always held under the seam which, accordingly, will be not subjected to any mechanical raising or grinding actions.

More specifically, tile peripheral rotary speed of the cusp element 8 can be controlled through a thru-phase AC motor, driven by an inverter, or by a brushless electric motor or, if desired, by a DC electric motor or by means of an electronic type of speed varying device.

The above mentioned cusp element, moreover, in addition to protecting the seamed regions under which it is arranged, will simultaneously cause the seamed regions to be separated from the cylinders 4, as it is clearly shown in FIGS. 1 and 2.

With respect to the grinding machine, the cusp element 8, after a rotation through 360° about the drum 3, will be stopped at the starting position A, waiting for the subsequent seam.

With respect to the raising machine, on the other hand, the cusp element 8, after a rotation about the drum 3 to the position C, will be stopped and caused to reverse its turning direction, thereby returning to its starting position B, waiting for a new seam.

From the above disclosure it should be apparent that the invention fully achieves the intended objects.

The invention, as disclosed, is susceptible to several variations and modifications, all of which will come within the scope of the inventive idea.

Moreover, all of the details can be replaced by other technically equivalent elements.

In practicing the invention, the used materials, provided that they are compatible to the intended use, as well as the contingent size and shapes can be any, according to requirements.

I claim:

1. In a grinding machine which comprises a drum, cylinder means for driving the fabric to be processed, said fabric having regions with seams, said regions having threads for connecting two adjoining pieces of fabric, a sensor to detect the presence of seams in the fabric, a seam protecting device which comprises at least one pair of concentric annular members (1), a drum (3) having bearing means (2) and a bottom portion, means for connecting said annular members to each other, driving cylinders (5) for supplying said fabric (7) to said drum at a controllable advancing speed, and grinding cylinders (4), a sensor (6) connected to said driving cylinders (5), a cusp-shaped member (8) located at said bottom portion of said drum, said cusp-shaped member being applied to said annular members (1) and rotating about said drum at a peripheral speed equal to said advancing speed of said fabric, said cusp-shaped member rotating around said drum, through 360 degrees, then stopping, whereby said seamed regions are separated from said cylinders (4) and breakage of said threads is prevented.

2. The seam protecting device according to claim 1 which comprises means for controlling the peripheral speed of said cusp member.

3. The seam protecting device according to claim 2 wherein said means are a three-phase AC motor driven by an inverter.

4. The seam protecting device according to claim 2 wherein said means are a brushless motor.

5. The seam protecting device according to claim 2 wherein said means are a DC motor.

6. The seam protecting device according to claim 2 wherein said means are an electronic type speed varying device.

7. The seam protecting device according to claim 1 which comprises a pulse counting device, said pulse counting device is coupled with said sensor, whereby the displacement of a seam with the displacement of said cusp member is timed.

8. In a raising machine which comprises a drum, cylinder means for driving the fabric to be processed, said fabric having regions with seams, said regions having threads for connecting two adjoining pieces of fabric, a sensor to detect the presence of seams in the fabric, a seam protecting device which comprises at least one pair of concentric annular members (1), a drum (3) having bearing means (2) and a bottom portion, means for connecting said annular members to each other, driving cylinders (5) for supplying said fabric (7) to said drum at a controllable advancing speed, a sensor (6) connected to said driving cylinders, a cusp-shaped member (8) applied to said annular members (1) and rotating about said drum at a peripheral speed equal to said advancing speed of said fabric, said cusp-shaped member rotating around said drum, through 360 degrees, then stopping and then reversing its direction of rotation whereby said seamed regions are separated from said cylinders (4) and breakage of said threads is prevented.

9. The seam protecting device according to claim 8 which comprises means for controlling the peripheral speed of said cusp member.

10. The seam protecting device according to claim 9 wherein said means are a three-phase AC motor driven by an inverter.

11. The seam protecting device according to claim 9 wherein said means are a brushless motor.

12. The seam protecting device according to claim 9 wherein said means are a DC motor.

13. The seam protecting device according to claim 9 wherein said means are an electronic type speed varying device.

14. The seam protecting device according to claim 8 which comprises a pulse counting device, said pulse counting device is coupled with said sensor, whereby the displacement of a seam with the displacement of said cusp member is timed.

* * * * *